US005844365A

United States Patent [19]

Natour

[11] Patent Number: 5,844,365

[45] Date of Patent: Dec. 1, 1998

[54] HIGH PRESSURE METAL HALIDE LAMP

[75] Inventor: Ghaleb Natour, Aachen, Germany

[73] Assignee: U.S. Philips Corporation, New York, N.Y.

[21] Appl. No.: 815,233

[22] Filed: Mar. 12, 1997

[30] Foreign Application Priority Data

Mar. 22, 1996 [EP] European Pat. Off. ..... 96200790

[51] Int. Cl.[6] ..... H01J 61/73

[52] U.S. Cl. ..... 313/633; 313/631; 313/632; 313/637; 313/638

[58] Field of Search ..... 313/631, 632, 313/633, 570, 571, 637, 638, 639, 640, 641, 642

[56] References Cited

U.S. PATENT DOCUMENTS 3,911,309 10/1975 Kummel et al. ..... 313/633

4,002,940 1/1977 Ekkelboom et al. ..... 313/633

FOREIGN PATENT DOCUMENTS 0627759 12/1994 European Pat. Off. .

07122234 5/1995 Japan .

*Primary Examiner*—Nimeshkumar Patel

*Attorney, Agent, or Firm*—F. Brice Faller

[57] ABSTRACT

A light transmitting discharge vessel encloses a discharge space, sealed in a gas-tight manner, in which electrodes connected to current conductors which extend to the exterior are disposed. A filling in the discharge vessel comprises a rare gas, a buffer gas and at least one transition metal halide chosen from the halides of hafnium, zirconium and tantalum. Each of the electrodes comprises an electrode part containing a carbide chosen from the carbides of hafnium, zirconium and tantalum. As a result diffusion of transition metal from the plasma into the electrode is strongly suppressed so that the lamp keeps very good color rendering properties throughout its operation.

12 Claims, 1 Drawing Sheet

HIGH PRESSURE METAL HALIDE LAMP

BACKGROUND OF THE INVENTION

The invention relates to a high pressure metal halide lamp comprising

- a light transmitting discharge vessel enclosing a discharge space, sealed in a gas-tight manner, in which electrodes are disposed, which are connected to current conductors which extend to the exterior,
- a filling in the discharge vessel comprising a rare gas, a buffer gas and at least one transition metal halide chosen from the halides of hafnium, zirconium and tantalum.

Such a high pressure metal halide lamp (further also indicated as lamp) is known from EP 0627759 A1.

In the known lamp mercury and/or xenon can for instance be used as buffer gases. The electrodes of the known lamp consist of tungsten bars. The known lamp has good colour rendering properties. Furthermore the efficacy and the luminance of the known lamp have a relatively high value.

A disadvantage of the known lamp is that during operation diffusion of the transition metal present in the plasma into the electrode takes place. As a result the composition of the plasma and therefore also the performance of the known lamp change during operation. More in particular the colour rendering properties of the lamp decrease very rapidly as a result of the disappearance of the transition metal from the plasma. The effect of the diffusion can partly be compensated by increasing the amount of transition metal halide in the filling of the lamp so that enough transition metal remains in the plasma after most of it has diffused into the electrode. It was found, however, that lamps containing such a large amount of transition metal halide had a very high reignition voltage rendering them unsuitable for many practical applications.

SUMMARY OF THE INVENTION

It is an object of the invention to provide a high pressure metal halide lamp which is suitable for many practical applications and having an improved maintenance.

According to the invention each of the electrodes comprises a first electrode part containing a carbide chosen from the carbides of hafnium, zirconium and tantalum.

During operation of the high pressure discharge lamp according to the invention the first electrode parts of the electrodes are facing the discharge and the discharge arc is present between the first electrode parts of the electrodes. It was found that in a high pressure metal halide lamp according to the invention migration of the transition metal from the plasma into the electrodes of the lamp is suppressed to a very large extent. As a result the composition of the plasma remains substantially unchanged and the excellent colour rendering properties of the lamp remain in existence throughout its operation. This is also true for lamps containing only a relatively small amount of transition metal halide in their filling. Preferably the amount of transition metal halide comprised in the discharge vessel is lower than 3 $\mu$mol/cm$^3$, so that the reignition voltage of the lamp is relatively low.

Good results have been obtained for high pressure metal halide lamps according to the invention wherein the first electrode parts were formed out of substantially pure transition metal carbide and also for high pressure metal halide lamps, wherein the first electrode parts in addition to the transition metal carbide also contain for instance tungsten and/or rhenium. Preferably the percentage by weight of tungsten and/or rhenium comprised in the first electrode parts is in the range 0%–30%.

The electrodes can comprise a second electrode part connected to the first electrode part. Depending on the composition of such a second electrode part a better connection between the current conductors and the second electrode parts can be realized than is possible between the current conductors and the first electrode parts. Favourable results have been obtained for high pressure metal halide lamps, wherein the second electrode parts comprise a tungsten bar. Preferably the first electrode part is fused to an end of the tungsten bar.

Preferably the first electrode parts are substantially spherical, substantially semi-spherical or cylindrical.

BRIEF DESCRIPTION OF THE DRAWING

In FIG. 1, 1 is a light transmitting discharge vessel enclosing a discharge space 2. The discharge vessel 1 is sealed in a gas-tight manner. Electrodes comprising first electrode parts 3*a* and 3*b* and second electrode parts 4*a* and 4*b* are disposed in the discharge vessel and connected to current conductors 5*a*, 6*a* and 5*b*, 6*b* which extend to the exterior. The current conductors each comprise a molybdenum foil (5*a* and 5*b*) and a conducting wire (6*a* and 6*b*) connected to the molybdenum foil. Each of the electrodes is also connected to one of the molybdenum foils. In the discharge vessel a filling is present comprising a rare gas, a buffer gas and an amount of $HfBr_4$ that is a solid at ambient temperature and is indicated in FIG. 1 as 6.

Figure 1:
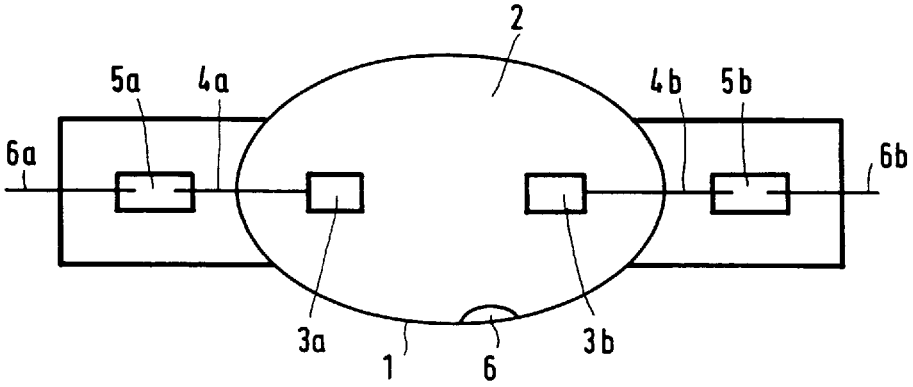
FIG. 1 shows an embodiment of a high pressure metal halide lamp according to the invention.
Figure 2:
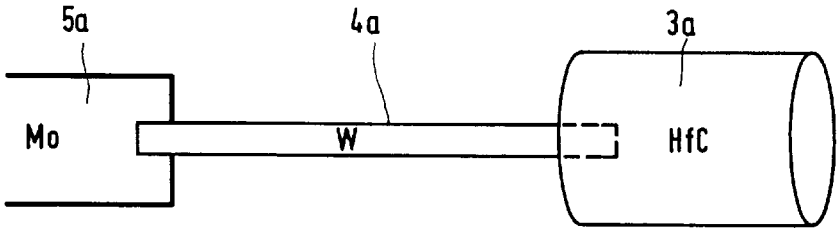
FIG. 2 shows a schematic representation of one of the electrodes in the high pressure metal halide lamp shown in FIG. 1.

Both of the electrodes present in the high pressure metal halide lamp of FIG. 1 are constructed as shown in FIG. 2 for one of these electrodes. It can be seen that the first electrode part consists of HfC while the second electrode part consists of a tungsten bar. The first electrode part is fused to the second electrode part. The second electrode part is connected to the molybdenum foil.

Table I shows a comparison of a high pressure metal halide lamp in accordance with the invention (LAMP 2) with a high pressure metal halide lamp having a similar filling but having electrodes that consist of tungsten bars (LAMP 1). The electrodes of LAMP 2 had first electrode parts that consisted of substantially pure HfC. The volume of the discharge space of the high pressure metal halide lamps was approximately 1 cm$^3$ and the electrode distance was 6 mm. Both lamps were filled with approximately 100 mbar of Ar at ambient temperature and with 134 $\mu$mol/cm$^3$ Hg and 1.34 $\mu$mol/cm$^3$ HfBr4. Both lamps were operated horizontally, without an outer bulb and the power supplied to the lamps was 250 watt.

TABLE I

| | LAMP 1 | LAMP 2 |
|---|---|---|
| Electrode construction: | tungsten bar | tungsten bar fused with first electrode part consisting of HfC |
| filled amount of $HfBr_4$ (at operation temperature) | 0.28 | 0.28 |
| Amount of $HfBr_4$ in the gas | <<0.1 | 0.28 |

TABLE I-continued

| | LAMP 1 | LAMP 2 |
|---|---|---|
| phase after 1 minute burning time (in bar): | | |
| Amount of $HfBr_4$ in the gas phase after 2 hours burning time (in bar): | <<0.1 | 0.28 |
| Lumen output (klm): | 16 | 17.5 |
| Efficacy (lm/Watt): | 64 | 70 |
| Colour rendering index R9: | −71 | 92 |
| Colour rendering index Ra8: | 66 | 97 |
| Colour rendering index Ra14: | 55 | 95 |
| Colour temperature (K): | 8520 | 7570 |
| Lamp voltage (V): | 94 | 90 |
| Reignition Voltage (V): | 140 | 160 |

Table II also shows a comparison of a high pressure metal halide lamp in accordance with the invention (LAMP 4) with a high pressure metal halide lamp having a similar filling but having electrodes that consist of tungsten bars (LAMP 3). The electrodes of LAMP 4 had first electrode parts that consisted of 30 wt. % tungsten and 70 wt. % HfC. The volume of the discharge space of the high pressure metal halide lamps was approximately 3,4 $cm^3$ and the electrode distance was 7 mm. Both lamps were filled with approximately 100 mbar of Ar at ambient temperature and with 74 $\mu mol/cm^3$ Hg, 2.4 $\mu mol/cm^3$ $HfBr_4$, 2.4 $\mu mol/cm^3$ $HgBr_2$ and 8.4 $\mu mol/cm^3$ Sn. Both lamps were operated horizontally, without an outer bulb and the power supplied to the lamps was 580 Watt.

TABLE II

| | LAMP 3 | LAMP 4 |
|---|---|---|
| Electrode construction: | tungsten bar | tungsten bar fused with first electrode part consisting of 30 wt. % tungsten and 70 wt. % HfC |
| filled amount of $HfBr_4$ (at operation temperature) | 0.5 | 0.5 |
| Amount of $HfBr_4$ in the gas phase after 1 minute burning time (in bar): | <0.08 | 0.5 |
| Amount of $HfBr_4$ in thegs phase after 2 hours burning time (in bar): | <0.04 | 0.5 |
| Lumen output (klm): | 42.511 | 46.270 |
| Efficacy (lm/Watt): | 73 | 80 |
| Colour rendering index R9: | 39 | 87 |
| Colour rendering index Ra8: | 89 | 98 |
| Colour rendering index Ra14: | 86 | 97 |
| Colour temperature (K): | 5240 | 4750 |
| Lamp voltage (V): | 72 | 97 |
| Reignition Voltage (V): | 160 | 240 |

Table I and Table II clearly show that Hf disappears from the plasma and into the electrodes of LAMP 1 and LAMP 3 at a very high rate during lamp operation and that this has a strong influence on the colour rendering properties of these lamps. It can also be seen that a reduction in the filled amount of $HfBr_4$ increases the difference in colour rendition between the lamp according to the invention and a lamp having electrodes consisting of tungsten bars. The amount of Hf in the plasma of LAMP 2 and LAMP 4 remains substantially at a constant level, as a result of which the colour rendering properties of LAMP 2 are very good. Furthermore, the reignition voltages of LAMP 2 and LAMP 4 are at acceptable values because of the relatively low amount of transition metal halide in the filling of the lamp. In separate experiments it was found that, in case of a lamp having electrodes consisting of tungsten bars, in order to have a colour rendering index Ra8 of at least 95, it was necessary to use a filled amount of $HfBr_4$ of 1.5 bar (at operation temperature). Of this filled amount only approximately 0.25 bar remained in the plasma while the rest diffused into the electrodes. Although the colour rendering index Ra8 remained at a high value throughout operation of the lamp, the reignition voltage was unacceptably high: between 800 V and 1000 V.

I claim:

1. A high pressure metal halide lamp comprising a light transmitting discharge vessel enclosing a discharge space, sealed in a gas-tight manner, in which electrodes are disposed, which electrodes are connected to current conductors which extend to the exterior, each electrode comprising a first electrode part in said discharge space, a filling in the discharge vessel comprising a rare gas, a buffer gas and at least one transition metal halide chosen from the halides of hafnium, zirconium and tantalum, wherein each said first electrode part contains a carbide chosen from the carbides of hafnium, zirconium and tantalum.

2. A high pressure metal halide lamp as claimed in claim 1, wherein the first electrode parts also contain tungsten and/or rhenium.

3. A high pressure metal halide lamp as claimed in claim 2, wherein the percentage by weight of tungsten and/or rhenium comprised in the first electrode parts is in the range 0%–30%.

4. A high pressure metal halide lamp as claimed in claim 3, wherein the electrodes further comprise a second electrode part connected to the first electrode part.

5. A high pressure metal halide lamp as claimed in claim 4, wherein the second electrode part is a tungsten bar.

6. A high pressure metal halide lamp as claimed in claim 5, wherein the first electrode part is fused to an end of the tungsten bar.

7. A high pressure metal halide lamp as claimed in claim 6, wherein said first electrode parts are substantially spherical.

8. A high pressure metal halide lamp as claimed in claim 6, wherein said first electrode parts are substantially semi-spherical.

9. A high pressure metal halide lamp as claimed in claim 6, wherein said first electrode parts are substantially cylindrical.

10. A high pressure metal halide lamp as claimed in claim 9, wherein the amount of transition metal halide comprised in the discharge vessel is lower than 3 $\mu mol/cm^3$.

11. A high pressure metal halide lamp as claimed in claim 1, wherein the electrodes further comprise a second electrode part connected to the first electrode part.

12. A high pressure metal halide lamp as claimed in claim 2, wherein the electrodes further comprise a second electrode part connected to the first electrode part.

* * * * *